US010625500B2

(12) United States Patent
Tuset et al.

(10) Patent No.: US 10,625,500 B2
(45) Date of Patent: Apr. 21, 2020

(54) INDICATIONS OF SIMILARITY FOR DROP DETECTOR SIGNALS

(71) Applicant: Hewlett-Packard Development Company, L.P., Houston, TX (US)

(72) Inventors: Pere Tuset, Sant Cugat del Valles (ES); Xavier Vilajosana, Sant Cugat del Valles (ES); Sheila Cabello, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/097,969

(22) PCT Filed: Jul. 25, 2016

(86) PCT No.: PCT/US2016/043887

§ 371 (c)(1),
(2) Date: Oct. 31, 2018

(87) PCT Pub. No.: WO2018/021998

PCT Pub. Date: Feb. 1, 2018

(65) Prior Publication Data

US 2019/0092002 A1 Mar. 28, 2019

(51) Int. Cl.
*B41J 2/045* (2006.01)
*B41J 2/165* (2006.01)
(Continued)

(52) U.S. Cl.
CPC ..... *B41J 2/04561* (2013.01); *B41J 2/04586* (2013.01); *B41J 2/125* (2013.01);
(Continued)

(58) Field of Classification Search
CPC .... B41J 2/04561; B41J 2/04586; B41J 29/38; B41J 2/125; B41J 2/165; B41J 2/26579; B41J 2/1953
See application file for complete search history.

(56) References Cited

U.S. PATENT DOCUMENTS 6,375,299 B1 4/2002 Foster et al.
6,763,482 B2 7/2004 Bernklau-halvor et al.
(Continued)

FOREIGN PATENT DOCUMENTS

CN 1361883 7/2002
CN 104487253 4/2015
(Continued)

OTHER PUBLICATIONS

Chen-Chu, T., et al., "Test Pattern and Drop Tracing for Nozzle Healthy Diagnostic", Ingenta Connect, Apr. 22, 2016, 2 pages.

*Primary Examiner* — Sharon A. Polk
(74) *Attorney, Agent, or Firm* — HP Inc. Patent Department

(57) ABSTRACT

In an example, a print apparatus includes a printhead carriage to receive a printhead comprising a print agent ejection nozzle, a drop detector to acquire a signal indicative of variations in a parameter detected by the drop detector over a period of drop detection, a memory to hold a print agent ejection signature, and processing circuitry. The processing circuitry includes a convolution module to convolve the drop detector signal with the print agent ejection signature, and the processing circuitry is to determine, from an output of the convolution module, an indication of similarity between the drop detector signal and the print agent ejection signature.

13 Claims, 6 Drawing Sheets

(51) Int. Cl.

| | |
|---|---|
| ***B41J 2/195*** | (2006.01) |
| ***B41J 29/38*** | (2006.01) |
| ***B41J 2/125*** | (2006.01) |

(52) U.S. Cl.

CPC ..... *B41J 2/165* (2013.01); *B41J 2/16579* (2013.01); *B41J 2/195* (2013.01); *B41J 29/38* (2013.01)

(56) References Cited

U.S. PATENT DOCUMENTS

| | | | | |
|---|---|---|---|---|
| 6,814,422 | B2 | 11/2004 | Bruch et al. | |
| 9,268,023 | B2 | 2/2016 | Garay et al. | |
| 2003/0020769 | A1* | 1/2003 | Sarmast ..... | B41J 2/125<br>347/7 |
| 2006/0031099 | A1* | 2/2006 | Vitello ..... | A61M 5/14212<br>705/2 |
| 2015/0198715 | A1 | 7/2015 | Garay et al. | |
| 2015/0201967 | A1* | 7/2015 | Modi ..... | G01N 21/59<br>600/34 |

FOREIGN PATENT DOCUMENTS

| | | | |
|---|---|---|---|
| EP | 1147900 | | 10/2001 |
| EP | 1226488 | B1 | 7/2009 |
| RU | 2427469 | C2 | 8/2011 |
| WO | WO-2006004210 | A1 | 1/2006 |

* cited by examiner

INDICATIONS OF SIMILARITY FOR DROP DETECTOR SIGNALS

BACKGROUND

Print apparatus utilise various techniques to disperse print agents such as coloring agent, for example comprising a dye or colorant, coating agents, thermal absorbing agents and the like. Such apparatus may comprise a printhead. An example printhead includes a set of nozzles and a mechanism for ejecting a selected agent as a fluid, for example a liquid, through a nozzle. In such examples, a drop detector may be used to detect whether drops are being ejected from individual nozzles of a printhead. For example, a drop detector may be used to determine whether any of the nozzles are clogged and would benefit from cleaning or whether individual nozzles have failed permanently.

BRIEF DESCRIPTION OF DRAWINGS

Non-limiting examples will now be described with reference to the accompanying drawings, in which.

DETAILED DESCRIPTION

Figure 1:
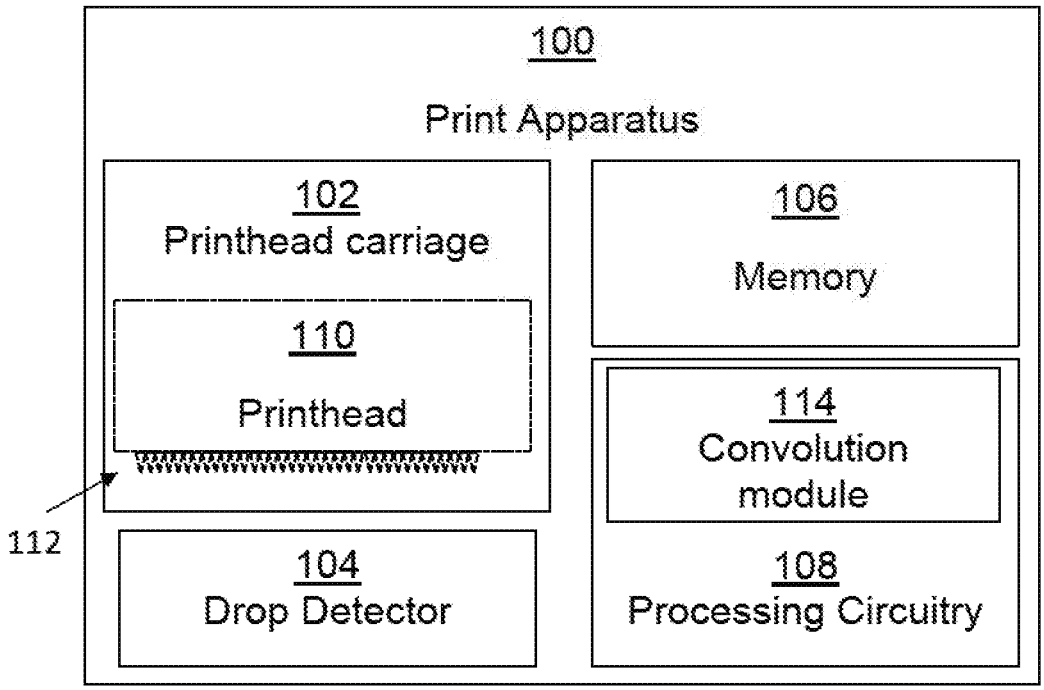
FIG. 1 is a simplified schematic of an example print apparatus.

FIG. 1 shows an example of a print apparatus 100, which may, for example, be for two-dimensional printing (for example for applying drops of a print agent such as ink on to a substrate such as paper, card, plastic, metal or the like) or three-dimensional printing (for example, applying drops of print agents which cause selective fusing or coloring of a build material, for example a powdered build material such as a plastic powder). The print apparatus 100 comprises a printhead carriage 102, a drop detector 104, a memory 106 and processing circuitry 108. In some examples, the print apparatus 100 may be configured, for example using the processing circuitry 108 thereof, to determine an operational status or performance parameter of at least one nozzle of a printhead mounted therein.

The printhead carriage 102 is to receive a printhead 110 (which may be a removable and/or replaceable component and is shown in dotted outline) comprising at least one print agent ejection nozzle 112. In some examples, the printhead carriage 102 may be mounted such that it can be repositioned in the print apparatus 100. In some examples the printhead 110 may be an inkjet printhead, such as a thermal inkjet printhead.

The drop detector 104 is to acquire a signal indicative of variations in a parameter detected by the drop detector 104 over a period of drop detection. In some examples, this signal may characterise the passage of print agent ejected from a nozzle through a sampling volume. However, as is further discussed below it may be that a nozzle has failed and there may be no print agent to detect in the period of drop detection. Nevertheless, the drop detector 104 may acquire a signal.

Figure 2:
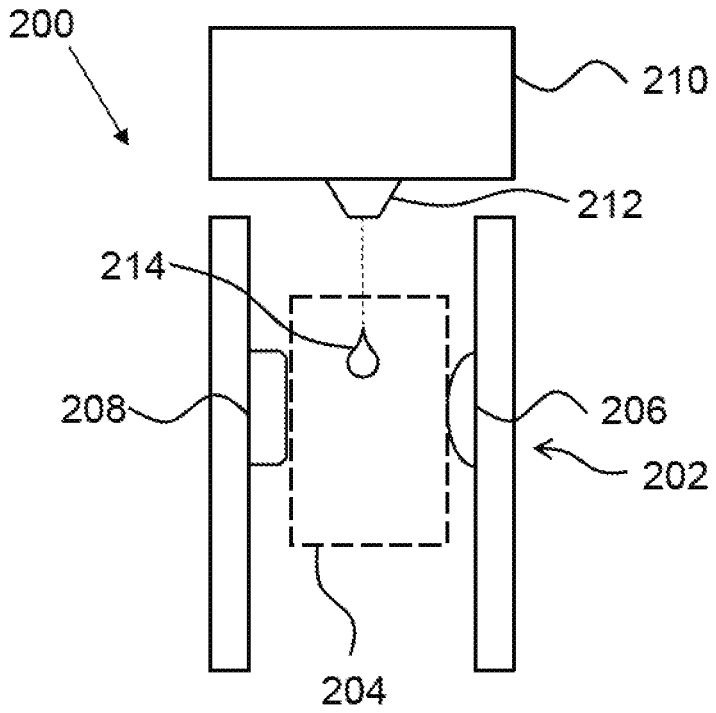
FIG. 2 is a simplified schematic of an example drop detector.

For example, a drop detector 104 may comprise at least one radiation detector and at least one radiation emitter (although ambient radiation could be detected in some examples). In such examples, the parameter which varies during a drop detection period may be radiation intensity level, although in other examples, it could be, for example, a wavelength parameter, a frequency parameter or any other parameter which may be collected by a drop detector. An example of a drop detector 104 is shown in FIG. 2 and discussed in greater detail below, in which a plurality of drop detection units each comprising a light source (e.g. at least one LED (Light Emitting Diode) and light detector (e.g. at least one photodiode) straddle a sampling volume and may detect a drop passing though the sampling volume. In other examples, other types of drop detector may be used, for example those based on gamma or beta ray radiation detection, or drop detectors with a mirror which returns the radiation emitted by an emitter to a collocated receiver, or which rely on light scattered back from the drop of print agent the like. In some examples, the drop detector 104 may be repositioned relative to the printhead carriage 102, such that it can detect the emission of drops from different nozzles 112 or sets of nozzles depending on its position.

In some examples, a print apparatus 100 may comprise a plurality of printhead carriages 102, each of which is to receive a printhead 110. In such examples, a drop detector 104 may be provided for each printhead carriage 102. In some examples, the drop detector 104 may be used to monitor each of a group of nozzles of a printhead 110 in turn. For example, a printhead 110 may comprise two thousand, one hundred and twelve nozzles, and the drop detector 104 may be positioned to detect the output of ninety six nozzles at a time.

The memory 106 holds a print agent ejection signature. As is set out in greater detail below, the print agent ejection signature may comprise a 'model' signal of the passage of print agent through a sampling volume of a drop detector, i.e. is indicative of how a parameter of a drop detector changes over a period of drop detection when a drop (which may be a drop having predetermined qualities) has been dispensed. In some examples, the print agent ejection signature may be an average signal generated from a plurality of calibration drop detection events. The memory 106 may be any form of computer readable storage medium, for example disc storage, CD-ROM, optical storage, magnetic storage, flash storage, memory caches, buffers, etc.

The processing circuitry 108 comprises a convolution module 114 to convolve the drop detector signal with a print agent ejection signature. The output of the convolution module 114 may be used to determine an indication of nozzle performance. The processing circuitry 108 may comprise any form of processing circuitry, for example, any or any combination of a CPU, processing unit, ASIC, logic unit, a microprocessor, programmable gate array or the like. The convolution module 114 may for example be implemented by a processor executing machine readable instructions stored in a memory, or a processor operating in accordance with instructions embedded in logic circuitry, or the like.

The convolution module 114 effectively acts as a filter, improving the signal-to-noise ratio in the acquired signal. In some examples, the nozzle performance may be determined based an indication of similarity derived from the convolved signal output from the convolution module 114.

In some examples, the drop detector signal and the print agent ejection signature are normalized prior to convolution. Such normalization means that system degradation (for example, degradation of the nozzle or the drop detector apparatus) does not impact the analysis of the signal. It allows the shapes of the signals, rather the absolute values, to be compared.

While in FIG. 1 the processing circuitry 108 and memory 106 are shown as being local to the printhead carriage 102 and the drop detector 104, this may not be the case and either may be remote thereto. For example, the processing circuitry 108 may receive data from the drop detector 104 and/or memory 106 remotely, for example via the Internet.

FIG. 2 shows an example of a drop detector 200 in conjunction with printhead 210. In this example, a plurality of drop detection units 202 (just one of which is visible in the view shown) straddle a sampling volume 204. Each drop detection unit 202 comprises a light source 206 and a radiation detector, in this example a light detector 208. The drop detection units 202 are arranged to detect a drop passing though the sampling volume 204 between the light source 206 and the light detector 208. For example, if the light source 206 of a drop detection unit 202 is emitting light, the arrangement may be such that this light is incident on the light detector 208 of the drop detection unit 202. A drop passing therebetween creates a shadow and the intensity of light detected by the light detector 208 decreases, allowing the presence of a drop to be detected. In this example, the light sources 206 comprise LEDs (Light Emitting Diodes), and the light detectors 208 may comprise photodiodes.

As is shown in FIG. 2, a printhead 210 may comprise a plurality of nozzles 212 (just one of which is visible in the view shown), which may each eject a drop 214. An example drop 214 may enter the sampling volume 204 at time T1. The drop 214 in this example has a 'tail' due to the way it exits a nozzle 212 (i.e. it may not be a spherical drop), which exits the sampling volume 204 at a later time T2. As the tail comprises less fluid, it may allow more light through and thus the light detected at a light detector 208 will decrease before gradually increasing.

Drop detectors may be used to identify when a nozzle of a printhead has ceased to emit print agents. There may be various reasons why a nozzle may not emit print agent. For example, in a thermal inkjet print apparatus, high temperatures can be reached within a firing chamber of the printhead and electrical components (for example, a resistive heating element which causes the heating) may break, rendering it inoperative. In addition, due to the high temperatures levels or simply over time, print agent may partially evaporate, leaving a solid residue (for example, where the print agent is ink, this residue may be ink pigments), 'Kogation' of a printhead nozzle may also occur, in which, over time, components of the ink may accumulate on a resistive heating element, which reduces its thermal emissions, making it less energy-efficient, and reducing the volume and velocity of drops fired. A nozzle may therefore become partially or completely inoperative, affecting the print apparatus image quality.

The information provided by a drop detector may allow an indication of the operational status of the nozzles of each printhead, which may provide feedback for use in error hiding mechanisms (for example, using an operative nozzle in place of an inoperative nozzle during printing), print apparatus maintenance and/or servicing, and the like. Incorrect feedback information can result in inappropriate error correction (and therefore image quality issues) or inappropriate servicing, or the like.

It is possible to use a peak-to-peak value of a drop detector signal to detect a drop. In a drop detector which is based on optical intensity, this peak-to-peak measurement may therefore indicate the maximum light intensity and the minimum light intensity over a sampling period. If this value is above a given threshold, the nozzle is considered to be in a good operational state. Conversely, if the peak-to-peak value is below the given threshold the nozzle may be considered to be in a poor operational state, for example being blocked or partially blocked.

While this approach is effective in many cases, it is reliant on the setting of the threshold. For example, a threshold may be set to be relatively low, so as to minimise the number of false designations of a nozzle as being faulty, but this means that a partially blocked or otherwise poorly functioning nozzle, which may emit a smaller volume of print agent, may be categorised as being in a good state until almost complete or complete failure. Moreover, such a threshold based approach may be vulnerable to electrical noise, either conducted or radiated, since such electrical noise may create peak-to-peak values that are above the threshold value. In some cases, the effect of electrical noise may be sufficient to generate a signal which has a significant peak-to-peak value, and this could lead to a nozzle being categorised as being fully operation regardless of its true state.

Figure 3A:
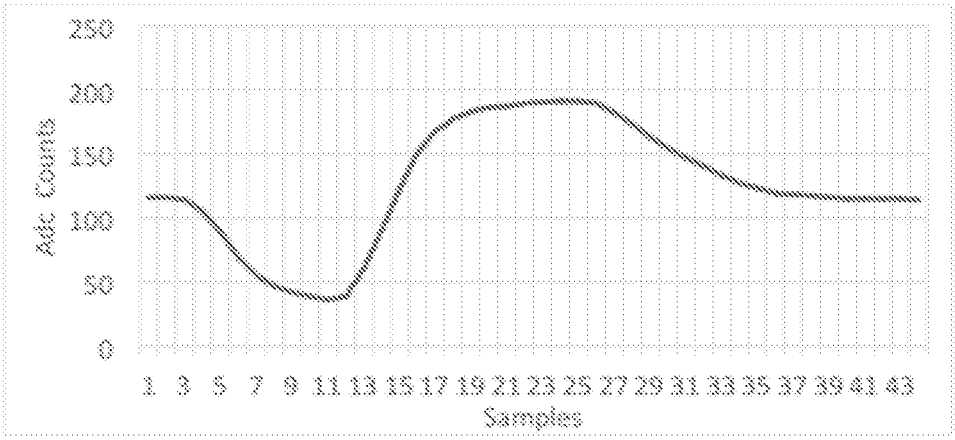
FIGS. 3A-C are examples of drop detector signals.

FIG. 3A shows an example of a drop detector signal which may be collected from a 'heathy' nozzle. As the liquid moves through the sampling volume 204, a count indicative of a radiation intensity value is recorded at intervals. In this example, therefore, radiation intensity values are collected over a drop detection period, i.e. a period in which print agent is intended to pass through the sampling volume 204 (on the assumption that print agent ejection has occurred, i.e. that the nozzle has not failed completely). As noted above, while the print agent falls though the sampling volume 204, the signal, which is indicative of the radiation intensity, drops before increasing. The increase in radiation intensity values above the original level is an artefact of the detector used: when the signal drops, the detector circuitry increases in sensitivity, and therefore increased to a higher level once the shadow of the print agent has passed before levelling out. In FIG. 3A, the 'peak-to-peak' value is 155.

Figure 3B:
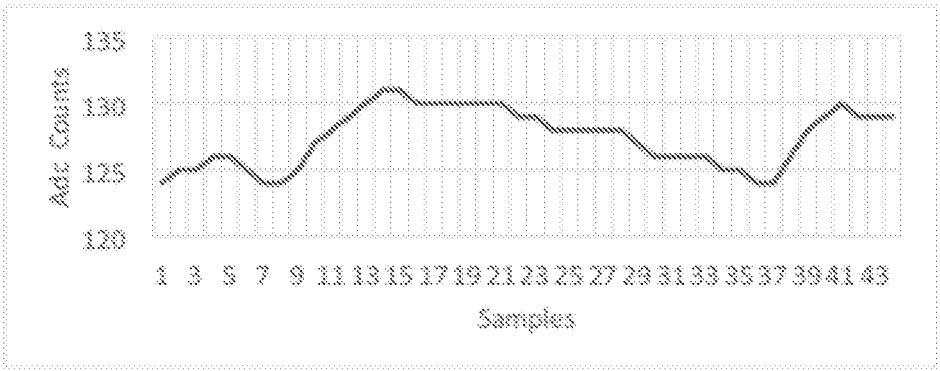

FIG. 3B shows an example of a drop detector signal which may be collected from a poorly performing nozzle. Although some liquid is being ejected and creating a shadow, the effect is smaller and the peak-to-peak value is 7.

Figure 3C:
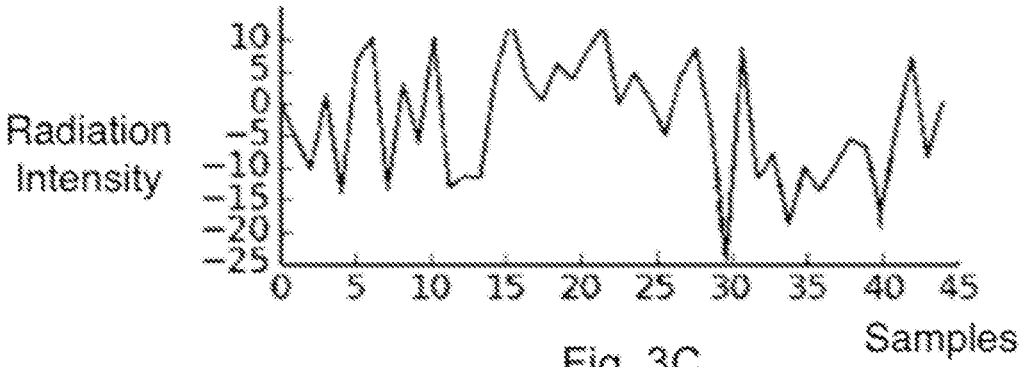

FIG. 3C shows an example of a signal which may be created purely with electrical noise which, even in the presence of cable and structure shielding, may be conducted or radiated and 'detected' by the drop detector as a false indication of radiation intensity. The peak-to-peak value of this signal is around 35. In some examples, in particular if the threshold is set relatively low, such a signal may be taken to be indicative of a 'drop event' even when none has occurred.

An example of a process for determination of a print agent ejection signature is now discussed with reference to FIG. 4.

At some time, for example during manufacturing of a print apparatus 100, an apparatus may be calibrated to obtain the signature that will be used in order to assess the nozzle health of each printhead 210. Such a calibration may take place for each anticipated print agent. For example, if the print agents to be used with a particular print apparatus 100 are colored inks, and a drop detector 104, 200 may be utilised to detect more than one ink color, then a signature may be determined for all the ink colors that is intended. A detection signal for each ink may differ due to different physical and chemical properties (e.g., drop weight, speed, opacity, etc.).

An example procedure to calibrate an print apparatus 100 for each ink color may comprise positioning a drop detector 104, 200 beneath a printhead nozzle which is known to be in a good operational state at a predetermined vertical distance (which may be the same as the intended vertical distance between the nozzle and the drop detector of the print apparatus 100 in use to ensure that the time taken for the ejected print agent to reach the sampling volume 204 is the same). The drop detector 104, 200 may then start capturing data as the nozzle ejects at least one volume of print agent. In some examples, the nozzle 212 may eject samples comprising different volumes of print agent. In use of the print apparatus 100, it may be that different amounts of print agents are delivered in different ejection events. These are often referred to in terms of 'drops', i.e. a single ejection event may comprise one drop or, say, five drops, where the ejection event with five drops contains five times the volume of print agent as the ejection event of one drop. By providing different sample signals for each volume, a signature which matches a number of anticipated ejection events may be created. The drop detector signals may be synchronized in time to ease data post-processing resource demands.

In some examples, an ejection event for each agent type (e.g. ink color) at each volume may be repeated a plurality of times and the data is stored. The number of times that each ejection event is repeated may be determined based on a trade-off between the time taken to acquire, store and process signals acquired during calibration and the capture of a representative dataset that may enhance detection.

The data may then be processed to obtain the print agent ejection signature(s). A signature may be created for each agent type at each volume. In some examples, a plurality of signals for a given agent type and volume are averaged to determine a signature. In other examples, one ejection event may form the basis of a print ejection signature and/or other techniques such as smoothing may be used.

Figure 4:
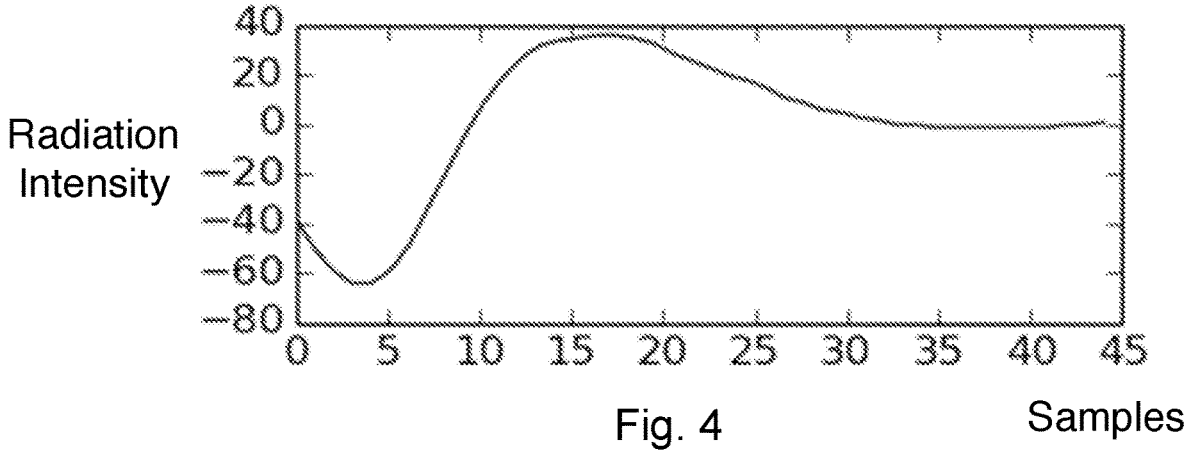
FIG. 4 is an example print agent ejection signature.

FIG. 4 shows a print agent ejection signature for a black ink, which in this example is obtained by averaging multiple signals of a nozzle that is known to be in good condition.

In some examples, the result may be normalized (that is, it is divided by the greatest absolute number, without taking into consideration the sign) to obtain a signal that may vary between −1 and 1. The resulting signal may be stored in a non-volatile machine readable storage for future use as a print agent ejection signature during a drop detection process.

As well as varying the agent type and volume, signatures for other variations may be created. For examples, a nozzle could be artificially misdirected, and a print agent ejection signature for a misirected nozzle and/or an undersized drop event, or the like could be determined as outline above. Such an artificial misdirection may be achieved by partially blocking a nozzle (or for example by failing to clean a nozzle such that a partial blockage occurs). This may result in the drops fired being misdirected. In another example, it may be possible to cause a build-up of print agent on a plate in which the nozzles are mounted. This may for example be achieved by 'spitting' i.e. repeated firing nozzles, for example at high firing frequency, resulting in a layer of ink building up on the printhead nozzle plate. Unless the plate is cleaned, subsequently fired drops will pass through this print agent layer and the drops may be misdirected. An undersized drop may be generated by reducing a voltage used to generate an ejection.

Figure 5:
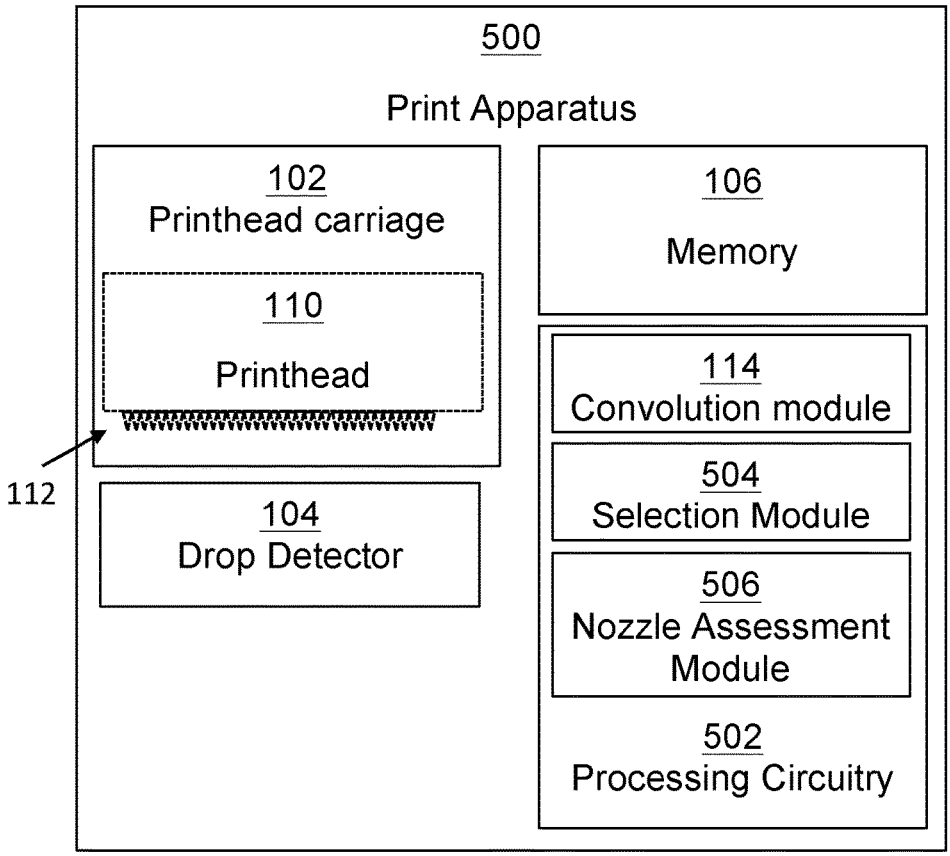
FIG. 5 is a simplified schematic of another example print apparatus.

FIG. 5 shows another example of a print apparatus 500. In addition to the components of the print apparatus 100 of FIG. 1, which are labelled with like numbers, the print apparatus 500 comprises processing circuitry 502 which comprises a selection module 504 and a nozzle assessment module 506. In this example, the memory 106 holds a plurality of print agent ejection signatures. In this example, different print agent ejection signatures are held for different print agent types and for different ejection volumes of those types. In addition, for at least one print agent type at at least one volume, a number of signatures are held relating to different ejection angles. The processing circuitry 502 and/or memory 106 may in some examples be remote from other parts of the print apparatus 500, for example connected thereto via the Internet or in some other way.

In some examples, a drop detection process occurs during normal print apparatus operation, and may for example be triggered by user of a print apparatus 500 or automatically, for example according to predetermined servicing routines. For example, a drop detection process may take place after a new printhead insertion or when a printhead has been in a 'capping position' (i.e. out of use) for a long time.

The selection module 504 selects at least one print agent ejection signature to convolve with a drop detector signal obtained following an intended print agent ejection based on at least one of: a type of the print agent (for example, a fusing agent, a coating agent, a colorant, etc.), a color of the print agent and an intended volume of print agent ejected. In this example, the selection module 504 selects all print agent ejection signatures which match the type of print agent and, if applicable, color which was intended to be ejected and the volume of print agent which was intended to be ejected.

In this example, the convolution module 114 convolves the drop detector signal with any and all selected print agent ejection signatures and identifies to which print agent ejection signature the drop detector signal is most similar. In this way, the print agent ejection may be characterised as being normal, absent or abnormal. An 'abnormal' status may be determined if the best match is to a signature relating to an offset ejection angle. The abnormality modelled by that signature could be associated with the ejection event and thus the nozzle from which the ejection event occurred.

Such a determination may be made by the nozzle assessment module 506, which determines an indication of similarity derived from an output of the convolution module 114 and determines therefrom an indication of the operational status of the nozzle from which the print agent was ejected.

In order to carry out the convolution, if the selected print agent ejection signature(s) are normalized, the drop detector signal may be normalized by dividing by the greatest absolute number (i.e. without taking into consideration the sign) to obtain a signal that is varies between at most −1 to 1.

The (in some examples normalized) drop detector signal may be convolved with a (in some examples, normalized) selected print agent ejection signature. The convolution process may for example be conducted in a time or frequency domain. In a time domain, the convolution process is performed directly. In the frequency domain the convolution process is performed by computing the Fast Fourier Transform (FFT) of each signal and then performing a multiplication of the result. Once both signals are multiplied, the result may be converted back to the time domain by computing the Inverse FFT (IFFT). Using the frequency domain instead of the time domain may reduce use of computational resources.

The result of the convolution may be used to determine an indication of similarity between the signal and the print agent ejection signature with which it is compared.

In some examples, a peak height may be used to determine an indication of similarity. For example, the signal strength may be based on the height of peaks identified in the convolved output. If for example a peak identified in the convolved output is above a threshold height, a drop detector signal and a given signature may be declared to match. In another example, several convolutions may be performed and the output of the convolution with the highest peak above a threshold may be declared to be the most similar and thus it may be concluded that the ejection event has the char characteristics associated with the conditions under which the signature was made (for example, a nozzle direction). If a high level of similarity is determined with a signature recorded for a nozzle in a good operational state, then the nozzle under test may be determined to be in a good operational state. Contrarily, if the peak is lower than a threshold height, then the nozzle may be determined to be in a poor operational state.

In another example, rather than being based on a threshold, a neural network may be trained using the calibration dataset to enhance determination of a nozzle status. In some examples, a neural network could be trained using the same signals obtained during a calibration exercise, for example carried out as part of the manufacturing process, to ensure that, after convolution (filtering) of the signal, the detection is specific to a particular set of print agent, number of drops and drop detector hardware (including the drop detector 104 and the processing circuitry 108, 502 which may be used in both calibration and determining indications of similarity).

Figure 6A:
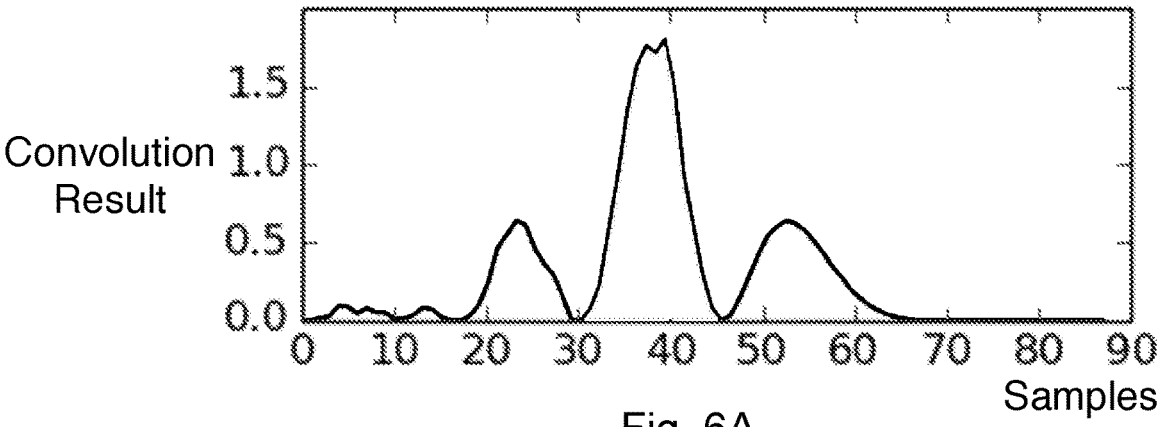
FIG. 6A-C show the results of example convolutions of drop detector signals and a print agent ejection signature.
Figure 6B:
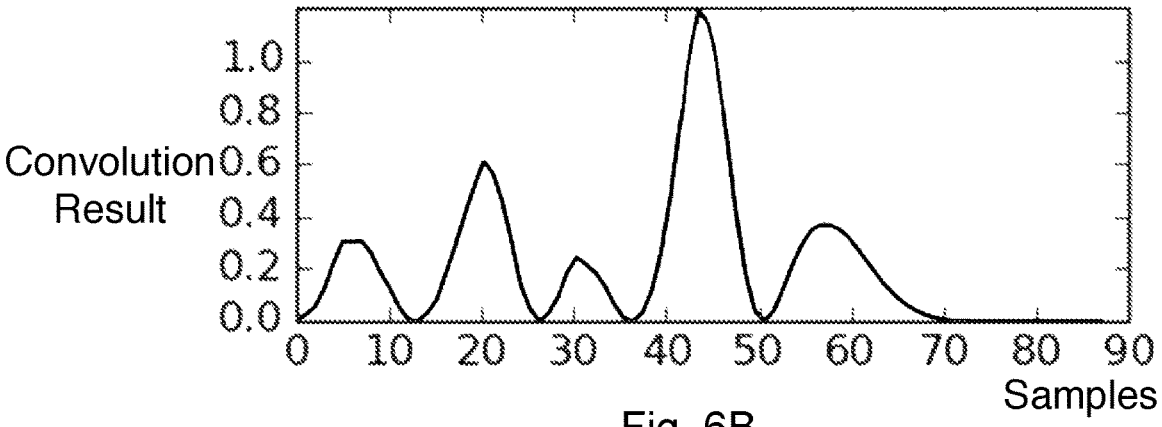
Figure 6C:
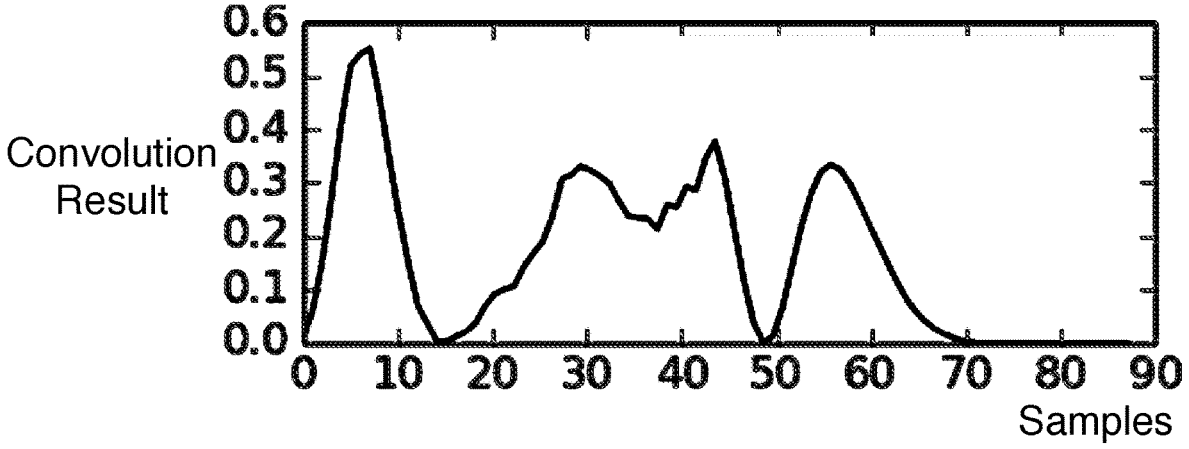

FIG. 6A shows an example of the result of a convolution between normalized versions of signature shown in FIG. 4 and the drop detector signal recording a first real drop event, specifically the drop event recorded in the graph of FIG. 3A. FIG. 6B shows an example of the result of a convolution between normalized versions of signature shown in FIG. 4 and the drop detector signal recording a second real drop event, specifically the drop event recorded in the graph of FIG. 3B. FIG. 6C shows an example of the result of a convolution between normalized versions of signature shown in FIG. 4 and the noise signal shown in FIG. 3C. These Figures may for example provide examples of the output of a convolution module 114.

In FIG. 6A, the highest peak has a height (which may be used to provide a similarity parameter) of around 1.8. This indicates a high level of similarity and thus it may be concluded that this ejection event was made from a fully functioning nozzle in a good operational state. In FIG. 6B, the similarity parameter is around 1.2. This indicates a lower level of similarity and thus it may be concluded that this ejection event was made from a nozzle in a poor operational state. However, if the similarity parameter is within a predetermined range, it may be determined that an ejection event did occur, albeit not as intended, or possibly that electrical noise may have disrupted the signal. In FIG. 6C, the similarity parameter is around 0.5. This indicates a low level of similarity and thus it may be concluded that the ejection event failed, and thus that the nozzles is in a failed state.

As can be seen, in this example, the highest similarity parameter may be used to identify the best match between the drop detector signals and the signature. The same would be true if a particular drop detector signal was convolved with a number of signatures, for example signatures relating to different ejection conditions. While some examples of similarity parameters have been given above, the thresholds used to determine the operational status of a nozzle may vary for example based on print agent color, type and the like.

In this manner, even if the print apparatus 500 is operating in an environment in which there is considerable electrical noise, correct determinations of nozzle status may be made, which in turn may result in an increase image quality.

Figure 7:
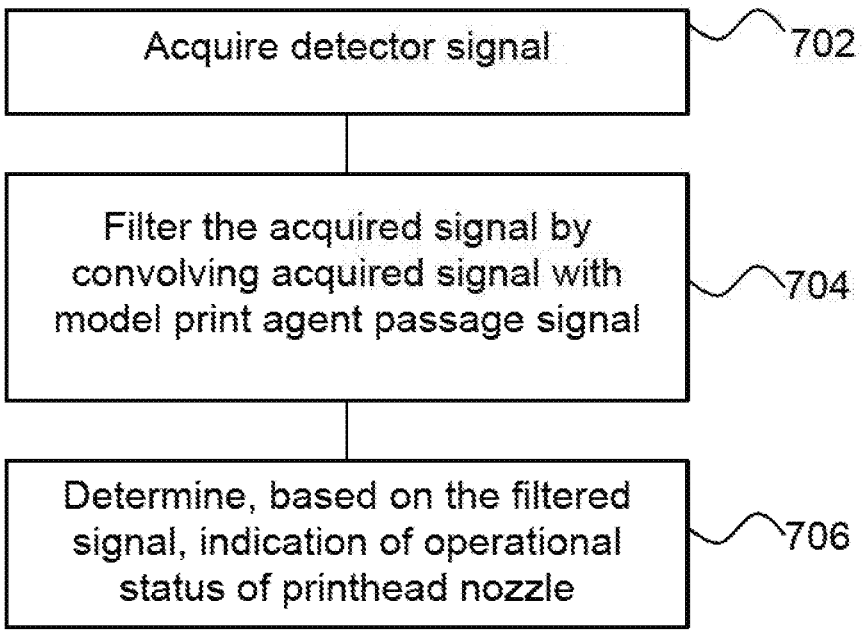
FIG. 7 is a flowchart of an example of a method of determining indication of an operational status of a printhead nozzle.

FIG. 7 is an example of a method, which may a computer implemented method, comprising, in block 702, acquiring a signal from a detector to detect the passage of a quantity of print agent ejected from a printhead nozzle (for example a drop detector). Note that, while the signal is from a detector which is to detect the passage of a quantity of print agent ejected from a printhead nozzle, the actual signal may have been acquired by the detector when there was no print agent to detect (for example, because a nozzle has failed). Block 704 comprises filtering the acquired signal by convolving the acquired signal with a model print agent passage signal. The model print agent passage signal may for example comprise a print agent ejection signature as discussed above. Block 706 comprises determining, based on the filtered signal, an indication of the operational status of the printhead nozzle.

Figure 8:
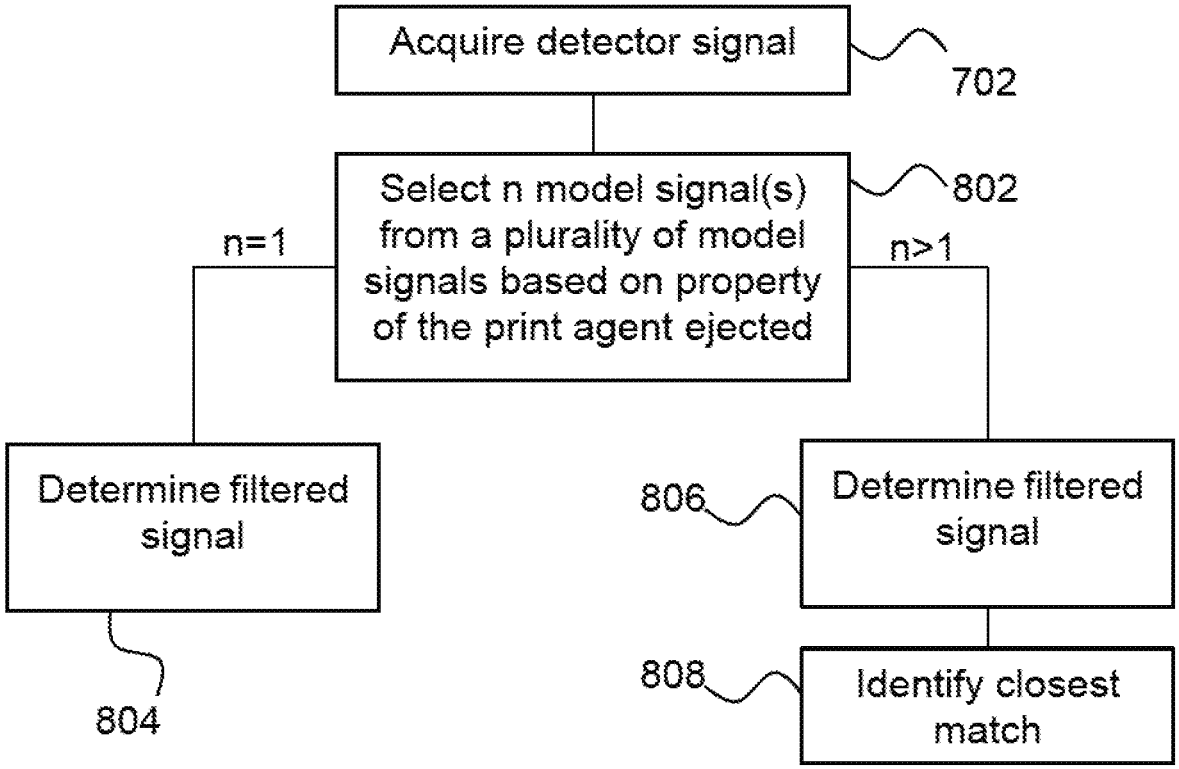
FIG. 8 is a flowchart of an example of method of determining at least one similarity parameter.

FIG. 8 is an example of method, which may be a computer implemented method. The method comprises block 702 as described in relation to FIG. 7. Block 802 comprises selecting at least one model print agent passage signal from a plurality of model print agent passage signals based on at least one property of a print agent of an intended print agent ejection. If one model print agent passage signal is selected, block 804 comprises determining a filtered signal using the selected model print agent passage signal. If more than one model print agent passage signal is selected, block 806 comprises determining filtered signal using the selected model print agent passage signals, and block 808 comprises identifying the model print agent passage signal which is the closest match to the acquired signal. In some examples, this may be closest match for which signal strength meets a predetermined threshold.

Figure 9:
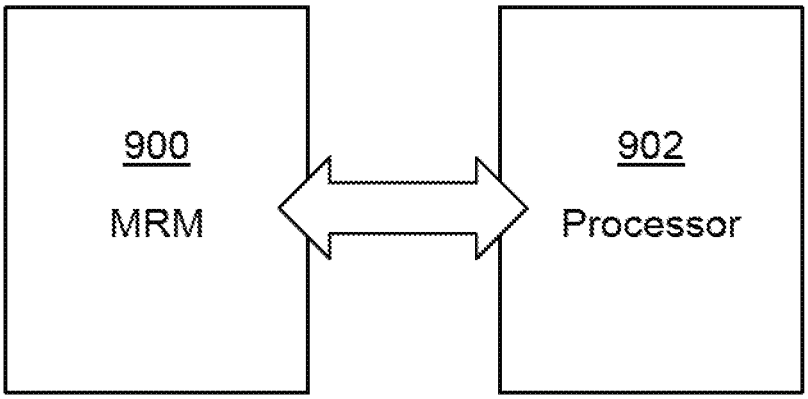
FIG. 9 is a simplified schematic of a example machine readable medium conjunction with a processor.

FIG. 9 is an example of a tangible machine readable medium 900 comprising instructions which, when executed by a processor 902, cause the processor 902 to (i) determine a property of print agent to be dispensed by a printhead in an ejection event (ii) identify a print agent ejection signature having that property; (iii) acquire a drop detector output signal following an attempt to eject the quantity of print agent; and (iv) determine, by convolving the pant agent ejection signature with the drop detector output signal, an indication of success of the ejection event. The indication of success may for example be positive, negative or intermediate, and may be based on a measure of the similarity between the print agent ejection signature and the drop detector output signal. In some examples, the machine readable medium 900 may comprise a data store. The data store may store a plurality of print agent ejection signatures, each print agent ejection signature being associated with at least one property, wherein at least one property comprises at least one of a print agent type, print agent color and a print agent volume. In some examples, the data store may store a plurality of print agent ejection signatures associated with a common set of properties. These print agent ejection signatures may for example differ in that they represent different print agent ejection conditions (e.g. different ejection angles or the like). The data store may comprise a memory, for example a memory 106 as descried in relation to FIG. 1 or FIG. 5.

Examples in the present disclosure can be provided, at least in part, as methods, systems or a combination of machine readable instructions and processing circuitry to execute the instructions. Such machine readable instructions may be included on a computer readable storage medium (including but is not limited to disc storage, CD-ROM, optical storage, etc.) having computer readable program codes therein or thereon.

The present disclosure is described with reference to flow charts and block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that some flows and/or blocks in the flow charts and/or block diagrams, as well as combinations of the flows and/or block in the flow charts and/or block diagrams can be realized by machine readable instructions in combination with processing circuitry.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus (for example, the convolution module 114, the selection module 504 and the nozzle assessment module 506) may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein ay be implemented in the form of a computer software product, the computer software product being shred its a storage medium and comprising a plurality of instructions for making a computer device-implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and many implementations may be designed without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A print apparatus comprising:

a printhead carriage to receive a printhead comprising a print agent ejection nozzle;

a drop detector to acquire a signal indicative of variations in a parameter detected by the drop detector over a period of drop detection;

a memory to hold a plurality of print agent ejection signatures; and processing circuitry comprising a convolution module to convolve the drop detector signal with the print agent ejection signatures, wherein the processing circuitry is to identify, from an output of the convolution module, the print agent ejection signature with which the drop detector signal is most similar.

2. A print apparatus according to claim 1 in which the drop detector comprises a radiation detector to detect radiation intensity, and the parameter comprises a radiation intensity value.

3. A print apparatus according to claim 1 in which the processing circuitry comprises a nozzle assessment module to determine, based on the print agent ejection signature with which the drop detector signal is most similar, an indication of an operational status of the nozzle from which the print agent was ejected.

4. A print apparatus according to claim 1 in which the processing circuitry is to determine the print agent ejection signature with which the drop detection similar is most similar from an indication of similarity from a peak height in the output of the convolution module for each print agent ejection signature.

5. A print apparatus according to claim 1 in which the drop detector signal and the print agent ejection signatures are normalized prior to convolution.

6. A method comprising:

acquiring a signal from a detector to detect a passage of a quantity of print agent ejected from a printhead nozzle;

filtering, using a processor, the acquired signal by convolving the acquired signal with a model print agent passage signal; and determining, using a processor and based on the filtered signal, an indication of an operational status of the printhead nozzle.

7. The method of claim 6 in which determining an indication of an operational status of the printhead nozzle comprises determining a similarity parameter based on the filtered signal.

8. The method of claim 6 further comprising selecting, using a processor, a model print agent passage signal from a plurality of model print agent passage signals based on a property of a print agent of an intended print agent ejection, and determining a filtered signal using the selected model print agent passage signal(s).

9. The method of claim 6 further comprising determining, using a processor, a filtered signal using each of a plurality of model print agent passage signals, and identifying the model print agent passage signal which is the closest match to the acquired signal.

10. The method of claim 9 in which identifying the model print agent passage signal which is the closest match to the acquired signal comprises determining the filtered signal having the highest peak.

11. A tangible machine readable medium comprising instructions which, when executed by a processor, cause the processor to:

determine a property of print agent to be dispensed by a printhead in an ejection event;

identify a print agent ejection signature associated with that property;

acquire a drop detector output signal following an attempt to dispense a quantity of print agent in the ejection event; and determine, by convolving the print agent ejection signature with the drop detector output signal, an indication of success of the ejection event.

12. A tangible machine readable medium according to claim 11 further comprising a data store, the data store comprising a plurality of print agent ejection signatures, each print agent ejection signature being associated with a property comprising at least one of a print agent color and a print agent volume.

13. A tangible machine readable medium according to claim 12 in which the data store comprises a plurality of print agent ejection signatures associated with a common set of properties.

* * * * *